US009095176B2

(12) United States Patent
Roberts et al.

(10) Patent No.: US 9,095,176 B2
(45) Date of Patent: Aug. 4, 2015

(54) SEAMLESS UNDERWEAR

(75) Inventors: Jennifer L. Roberts, Merriam, KS (US); Jeffrey C. Dalbey, Leawood, KS (US); Mark W. L. Smith, DeSoto, KS (US)

(73) Assignee: Knit-Rite, Inc., Kansas City, KS (US)

( * ) Notice: Subject to any disclaimer, the term of this patent is extended or adjusted under 35 U.S.C. 154(b) by 960 days.

(21) Appl. No.: 13/270,991

(22) Filed: Oct. 11, 2011

(65) Prior Publication Data

US 2012/0084903 A1 Apr. 12, 2012

Related U.S. Application Data

(60) Provisional application No. 61/391,226, filed on Oct. 8, 2010.

(51) Int. Cl.

| | |
|---|---|
| ***A41B 9/02*** | (2006.01) |
| ***A41B 9/04*** | (2006.01) |
| ***D04B 1/24*** | (2006.01) |
| ***D04B 1/10*** | (2006.01) |
| *A41B 9/00* | (2006.01) |

(52) U.S. Cl.

CPC ... *A41B 9/02* (2013.01); *A41B 9/04* (2013.01); *D04B 1/106* (2013.01); *D04B 1/243* (2013.01); *A41B 9/004* (2013.01); *A41B 2500/10* (2013.01)

(58) Field of Classification Search

CPC ..... A41B 9/001
USPC ..... 2/400, 401, 402, 409, 79, 228, 238; 66/171, 175, 176, 177

See application file for complete search history.

(56) References Cited

U.S. PATENT DOCUMENTS

| | | | | |
|---|---|---|---|---|
| 1,868,854 | A * | 7/1932 | Smarr | 66/175 |
| 2,076,748 | A * | 4/1937 | Schweig | 66/175 |
| 2,249,198 | A * | 7/1941 | Carter | 2/404 |
| 3,141,318 | A | 7/1964 | Griffith | |
| 3,802,229 | A | 4/1974 | Fregeolle | |
| 3,956,909 | A | 5/1976 | Negri | |
| 4,445,345 | A * | 5/1984 | Bedier | 66/177 |
| 5,280,652 | A * | 1/1994 | Davis et al. | 2/409 |
| 5,836,179 | A | 11/1998 | van Laar | |
| 6,158,253 | A | 12/2000 | Svoboda et al. | |
| 6,276,175 | B1 | 8/2001 | Browder, Jr. | |
| 6,622,312 | B2 * | 9/2003 | Rabinowicz | 2/401 |

(Continued)

FOREIGN PATENT DOCUMENTS

| | | |
|---|---|---|
| BE | 789902 A1 | 2/1973 |
| EP | 516905 A2 | 12/1992 |

(Continued)

OTHER PUBLICATIONS

PCT Search Report and Written Opinion from PCT Application No. PCT/US2011/055820 entitled Seamless Underwear (Dated May 15, 2012).

(Continued)

*Primary Examiner* — Tejash Patel
(74) *Attorney, Agent, or Firm* — Hovey Williams LLP

(57) ABSTRACT

A stretchable seamless underwear is operable to be donned by a wearer and includes a seamless knitted fabric receptacle. The receptacle includes integrally knitted front and back panels that each present opposite side margins, with each side margin of the front panel being seamlessly joined to a corresponding side margin of the back panel so that the panels cooperatively form a passage through the receptacle. The receptacle is knitted with a high-stretch yarn.

35 Claims, 6 Drawing Sheets

(56) References Cited

U.S. PATENT DOCUMENTS

| | | | | |
|---|---|---|---|---|
| 7,363,778 | B2 | 4/2008 | Pickering et al. | |
| 7,395,557 | B1 * | 7/2008 | Ledyard | 2/113 |
| 7,575,561 | B2 | 8/2009 | Smith et al. | |
| 7,895,863 | B2 | 3/2011 | Smith et al. | |
| 2010/0005568 | A1 | 1/2010 | Smith et al. | |

FOREIGN PATENT DOCUMENTS

| | | | |
|---|---|---|---|
| EP | 2082653 | A1 | 7/2009 |
| JP | 2002275702 | A | 9/2002 |
| JP | 2002327303 | A | 11/2002 |
| JP | 2003278001 | A | 10/2003 |

OTHER PUBLICATIONS

European Search Report and Written Opinion from European Application No. EP 11831763entitled Seamless Underwear (Dated Sep. 30, 2014).

Declaration of Jeff C. Dalbey (Declaration dated Mar. 9, 2015).

* cited by examiner

SEAMLESS UNDERWEAR

RELATED APPLICATION

This application claims the benefit of U.S. Provisional Application Ser. No. 61/391,226, filed Oct. 8, 2010, entitled SEAMLESS UNDERWEAR, which is hereby incorporated in its entirety by reference herein.

BACKGROUND

1. Field

The present invention relates generally to fabric garments. More specifically, embodiments of the present invention concern seamless underwear with various sections that are integrally knitted to one another.

2. Discussion of Prior Art

Various styles of underwear have been used for many years. Conventional underwear is knitted on circular knitting machines and is then cut and tailored with seams. This traditional process is used to produce various underwear styles for men and women, such as briefs, boxers, boxer briefs, bikini and hipster. Furthermore, the traditional process is able to provide these and other underwear styles in a variety of sizes and fits.

Prior art underwear suffer from various problems and limitations. For instance, conventional underwear can interact with the wearer to cause significant discomfort. Wearers are often exposed to pinching of skin, skin abrasion, tugging or plucking of hair, or other noticeable discomfort due to the tailored construction. It has been found that such discomfort is particularly acute and problematic for children with Sensory Processing Dysfunction, Autism, Tourette's Syndrome, and other disorders. Furthermore, other activities involving adults and children, such as riding horses, riding bicycles and motorcycles, and driving other types of vehicles have been found to intensify symptoms of discomfort from wearing conventional underwear. Yet further, skin pressure caused by seam thickness causes discomfort and leads to decubitous ulcers in individuals with paraplegic, quadriplegic, and other conditions, where the person is in a seated (or other) weight-bearing position for prolonged periods of time. Consequently there is a need in the art for underwear that is constructed to limit the above-referenced conditions and symptoms of discomfort.

SUMMARY

The following brief summary is provided to indicate the nature of the subject matter disclosed herein. While certain aspects of the present invention are described below, the summary is not intended to limit the scope of the present invention.

Embodiments of the present invention provide seamless underwear that does not suffer from the problems and limitations of prior art underwear, some of which are set forth above.

A first aspect of the present invention concerns a stretchable seamless underwear operable to be donned by a wearer. The stretchable seamless underwear broadly includes a seamless knitted fabric receptacle that includes integrally knitted front and back panels that each present opposite side margins, with each side margin of the front panel being seamlessly joined to a corresponding side margin of the back panel so that the panels cooperatively form a passage through the receptacle. The receptacle includes an uppermost knitted waist band that is integrally knitted with the front and back panels and forms an upper waist opening dimensioned and configured to receive the torso of the wearer when the underwear is donned. The front and back panels cooperatively define a tapered section of the receptacle. The receptacle has an unstretched condition where the tapered section presents a cross-sectional passage dimension tapering in a direction toward the uppermost waist band so that the receptacle is operable to be retained on the wearer when the underwear is donned.

A second aspect of the present invention concerns a stretchable seamless underwear operable to be donned by a wearer. The stretchable knitted underwear broadly includes a seamless knitted fabric receptacle that includes integrally knitted front and back panels that each present opposite side margins, with each side margin of the front panel being seamlessly joined to a corresponding side margin of the back panel so that the panels cooperatively form a passage through the receptacle. The receptacle presents an uppermost waist opening dimensioned and configured to receive the torso of the wearer when the underwear is donned. The receptacle defines a pair of lower leg openings between the front and back panels, with the leg openings operable to receive a corresponding leg of the wearer when the underwear is donned. The back panel includes upper and lower sections. The upper and lower sections are at least partly joined along a laterally extending line of fashionings located vertically between the waist opening and the leg openings so that the back panel presents a fashioned interior pocket operable to receive the buttocks of the wearer when the underwear is donned.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 10:
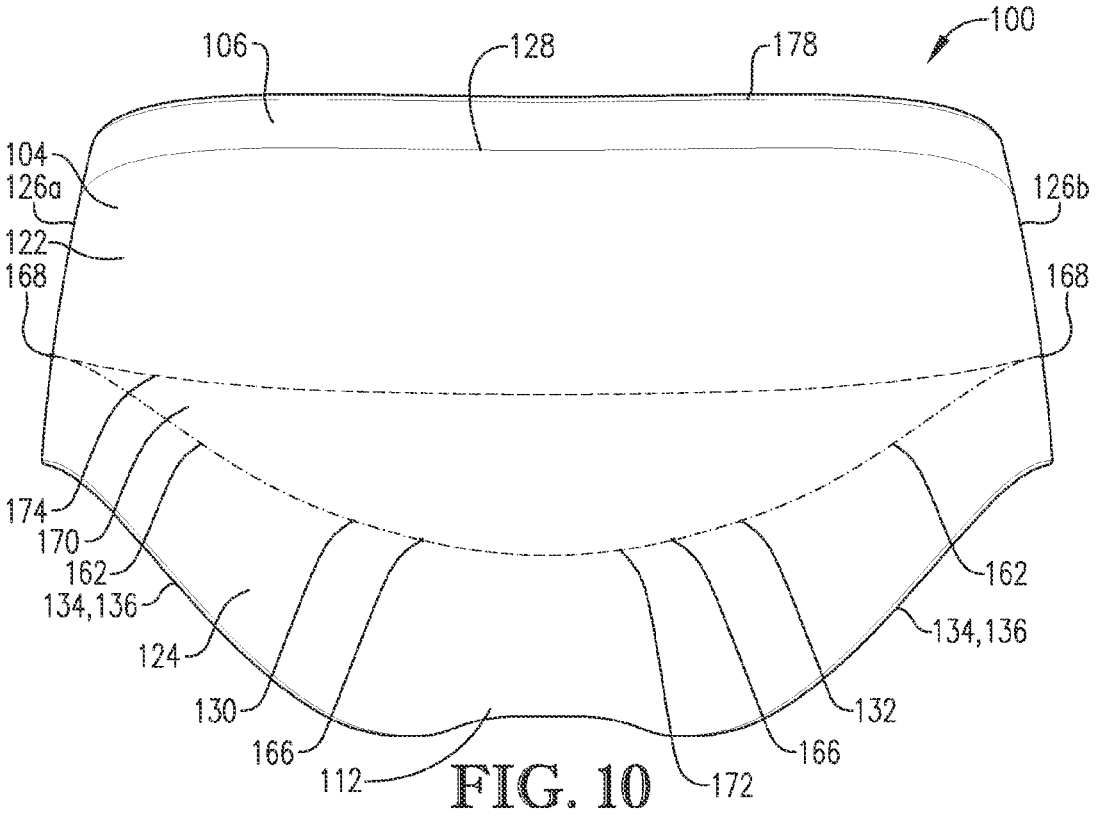
FIG. 10 is a rear elevation of the seamless underwear similar to FIG. 8, but showing the underwear in the stretched condition.
Figure 11:
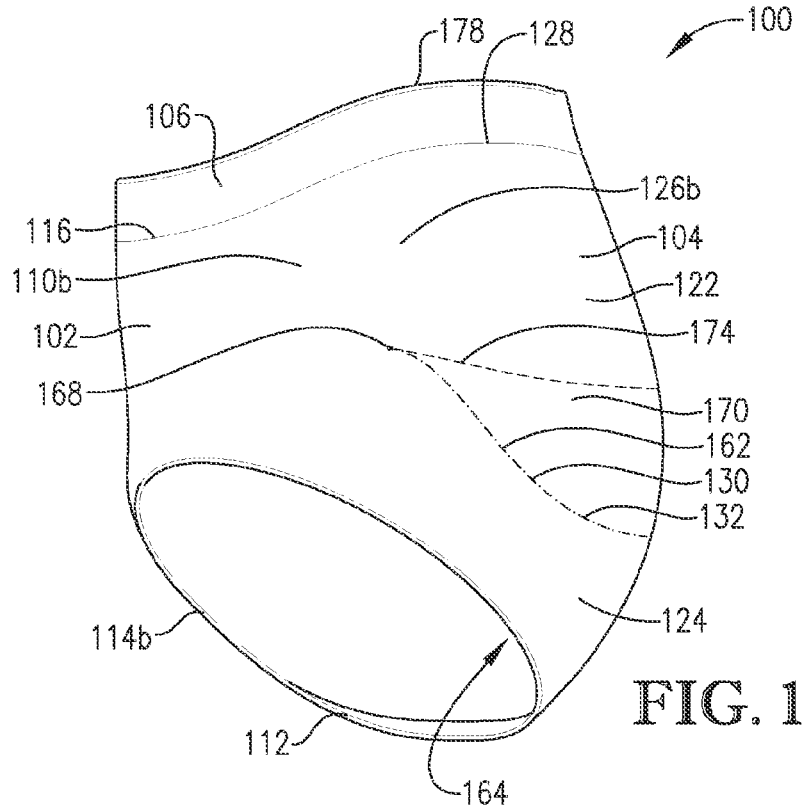
Figure 12:
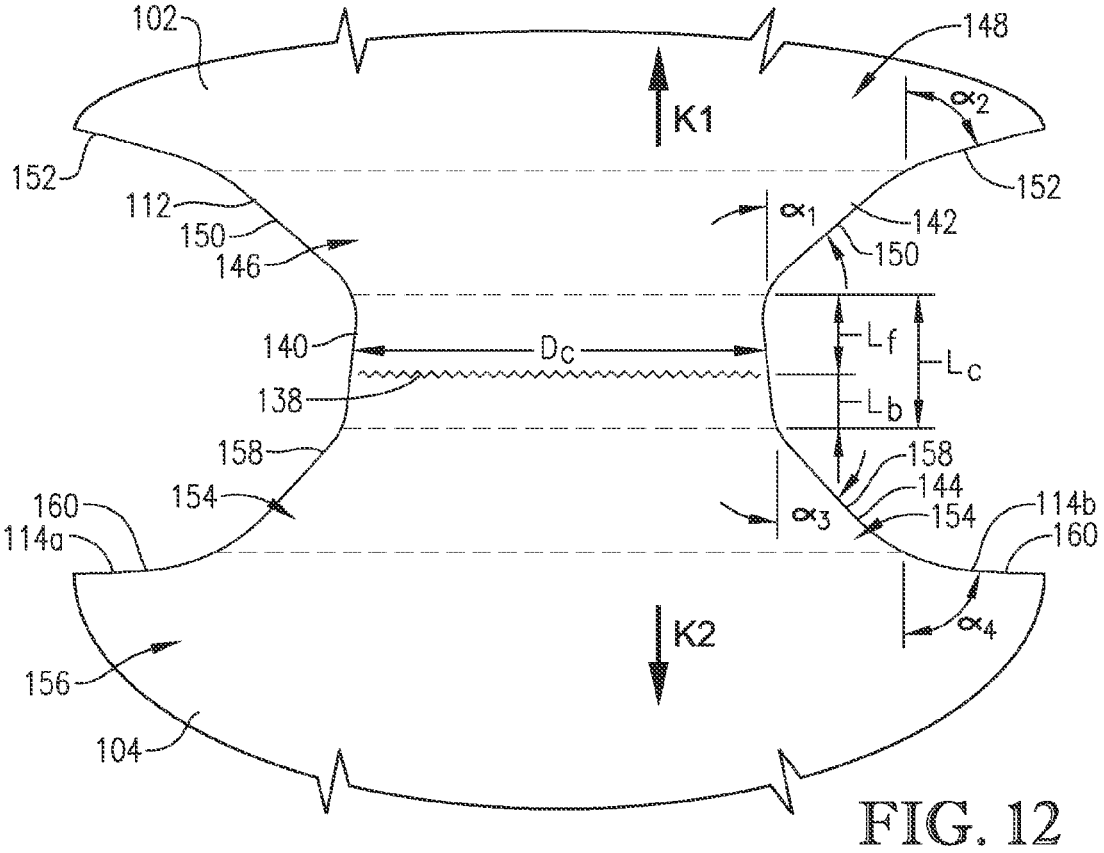

FIG. 11 is a left side elevation of the seamless underwear shown in FIGS. 7-10, with the underwear being in the stretched condition; and FIG. 12 is a fragmentary bottom view of the seamless underwear shown in FIGS. 7-11, showing a crotch area of the underwear located between the leg openings, with the crotch area including a central portion and front and back fashioning portions that define the shape of the leg openings.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
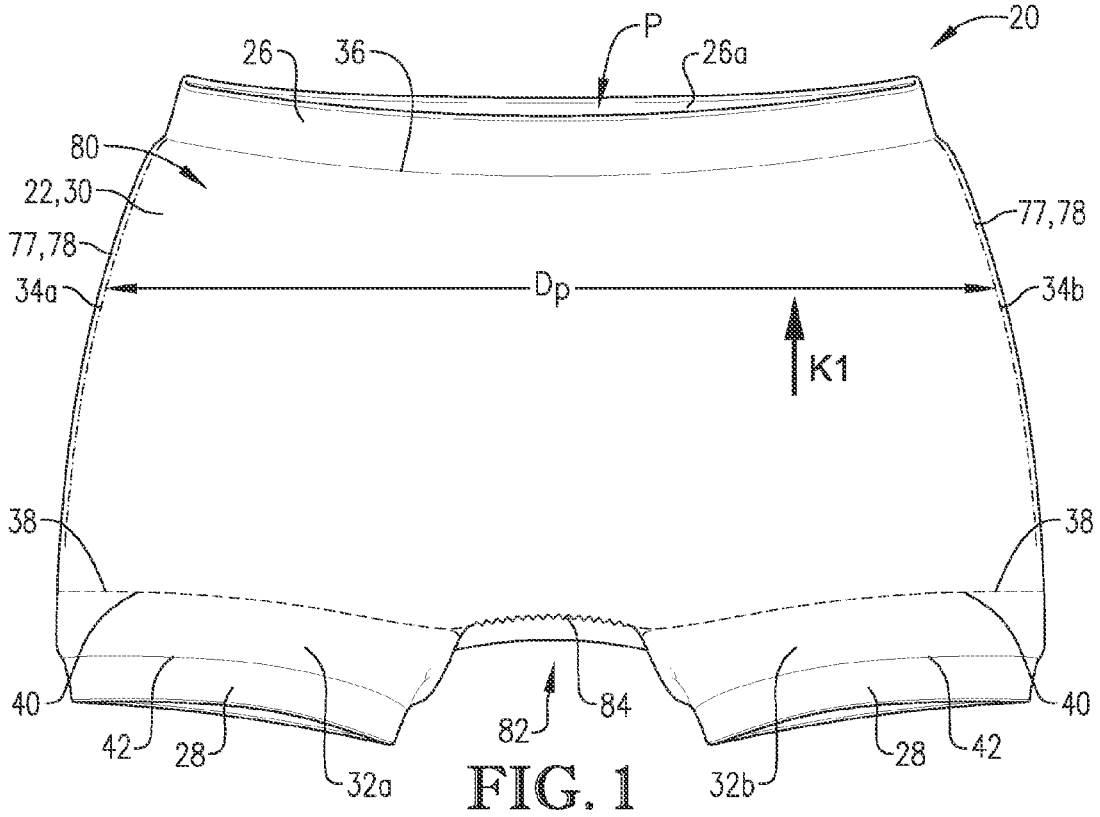
FIG. 1 is a front elevation of a seamless underwear constructed in accordance with a first embodiment of the present invention, with the underwear being depicted in an unstretched condition and including front and back panels, leg sections, a waist band, and leg bands.
Figure 2:
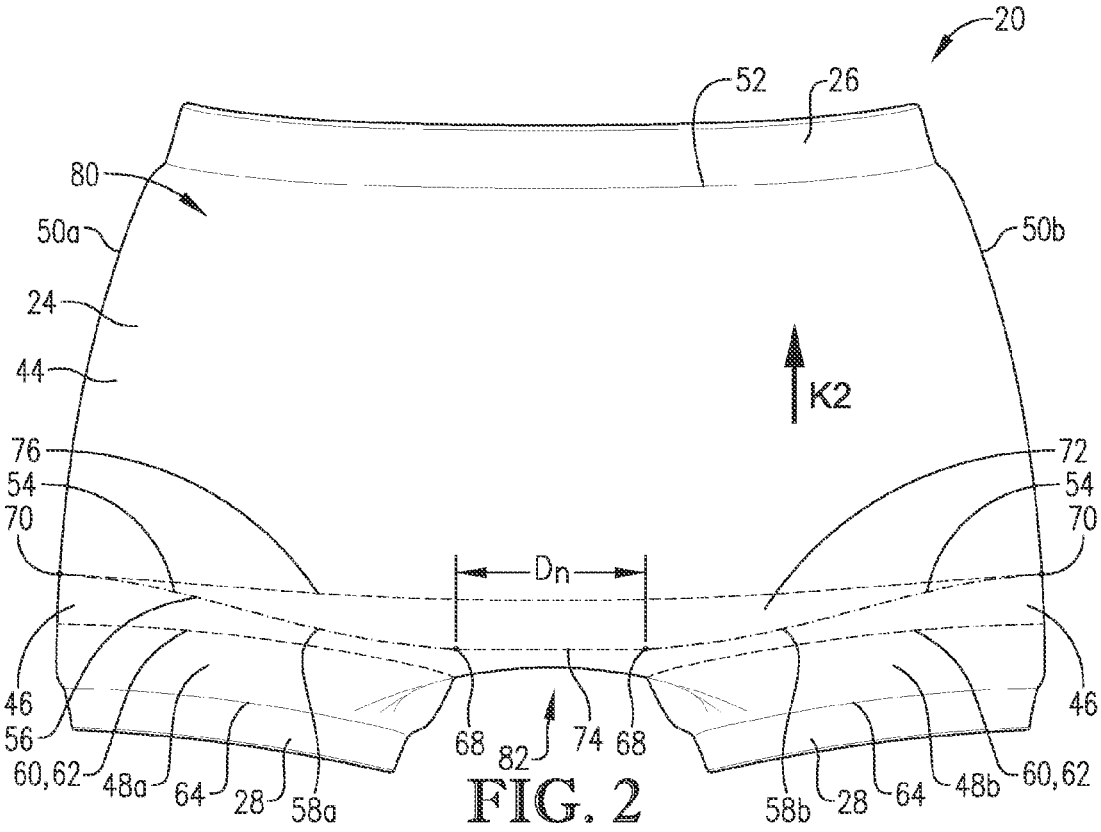
FIG. 2 is a rear elevation of the seamless underwear shown in FIG. 1, showing upper and lower trunk sections of the back panel, with the sections being integrally joined along lines of fashioned knit construction (depicted schematically) so that the back panel forms an interior pocket.

Turning initially to FIGS. 1 and 2, a seamless underwear 20 is dimensioned and configured to be donned by a wearer (not shown). When donned, the underwear 20 is preferably designed to fit against the wearer's skin without causing discomfort to the wearer. The illustrated underwear 20 preferably comprises a receptacle in the form of a boxer brief underwear style. However, it is also within the ambit of the present invention where the seamless underwear 20 takes the form of an alternative style, such as boxer, brief, bikini, and hipster. The illustrated underwear 20 is designed as a boy's underwear. However, in view of the various alternative styles for underwear 20, those of ordinary skill in the art will appreciate that underwear 20 could be configured for girls, adult men, or adult women. For instance, one suitable alternative underwear configuration for girls will be shown in a subsequent embodiment. The seamless underwear 20 broadly includes front and back panels 22,24, a waist band 26, and leg bands 28.

The illustrated seamless underwear 20 is preferably made to be highly stretchable so that the underwear 20 conforms to the shape of the wearer and fits snugly. The underwear 20 preferably includes a high-stretch yarn and, more preferably, is knitted of a core-spun yarn. Generally, such high-stretch yarns include polyester and lycra, but could include other materials to provide suitable performance. As will be appreciated, various yarn materials, yarn deniers, and yarn tensions could be employed to knit the underwear 20 without departing from the scope of the present invention. Details of some preferred high-stretch yarns are disclosed in U.S. Pat. No. 7,895,863, issued Mar. 1, 2011, entitled GRADIENT COMPRESSION HOSIERY KNITTED USING CORESPUN YARNS, which is hereby incorporated in its entirety by reference herein.

The underwear 20 is preferably entirely knitted so that the underwear 20 is substantially seamless. As will be discussed in greater detail, the underwear 20 is a weft-knitted garment that is preferably formed on a flat bed knitting machine. Knitting is generally performed along knitting directions K1,K2 generally associated with respective front and back panels of the underwear 20. As will also be discussed, multiple types of knitting stitches are used to form the illustrated underwear 20.

Figure 3:
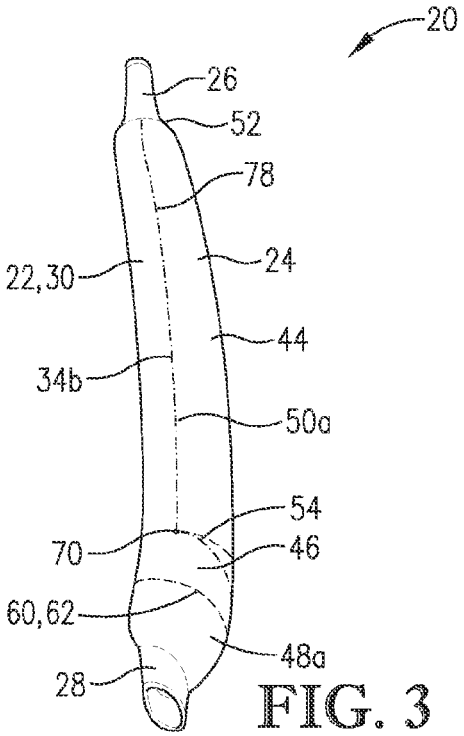
FIG. 3 is a left side elevation of the seamless underwear shown in FIGS. 1 and 2.
Figure 4:
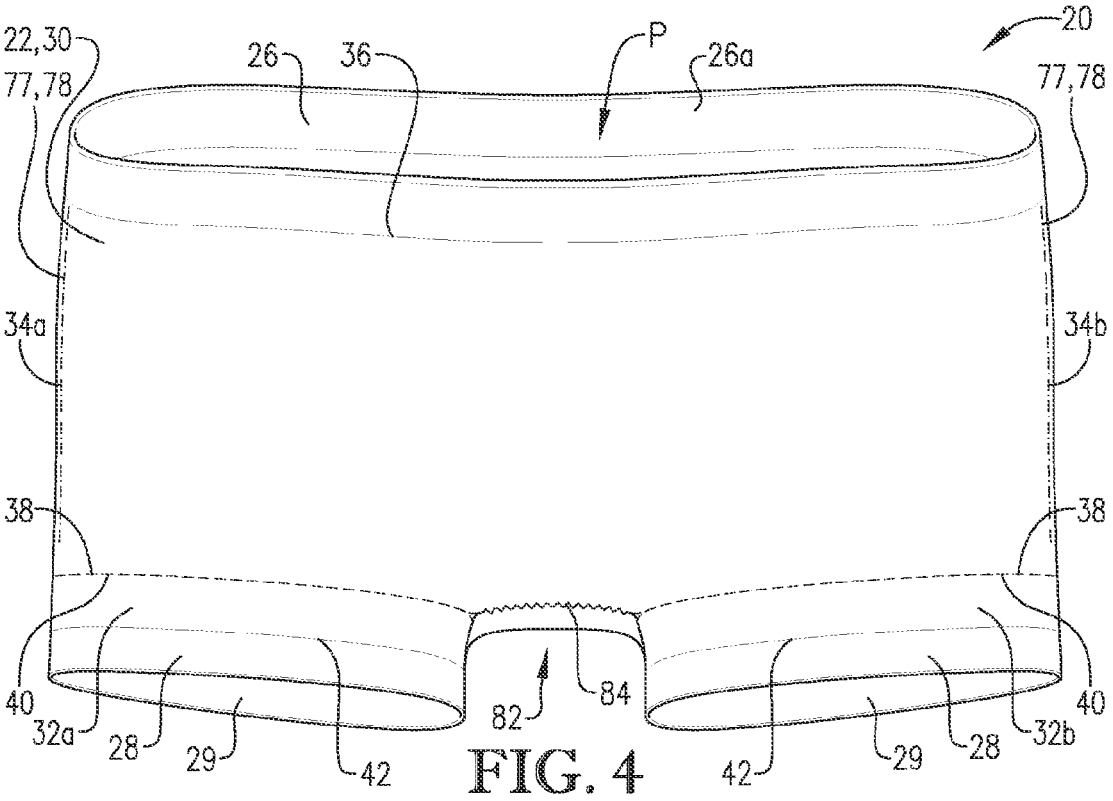
FIG. 4 is a front elevation of the seamless underwear similar to FIG. 1, but showing the underwear in a stretched condition generally associated with donning of the underwear.

Turning to FIGS. 1-3, the underwear 20 preferably includes a waist band 26 knitted to form the top margin of the receptacle and define a waist opening 26*a* (see FIGS. 1 and 4). The waist band 26 is knitted by a single yarn carrier on a multi-system machine (i.e., where front and back panels are supplied from a single yarn carrier). Furthermore, the waist band 26 is preferably formed by ¼-gauge knitting on the flat bed knitting machine. That is, the waist band 26 is knitted by one in every four needles along the flat bed knitting machine. For some aspects of the present invention, the underwear could have an alternatively constructed waist band, such as a ½-gauge knit or a mock knit rib. While the underwear 20 is preferably unitary, the underwear could include a drawstring and/or an elastic member that extends through the waist band. Furthermore, various yarn thread materials, tensions, and deniers could be used to produce the waist band 26.

Figure 6:
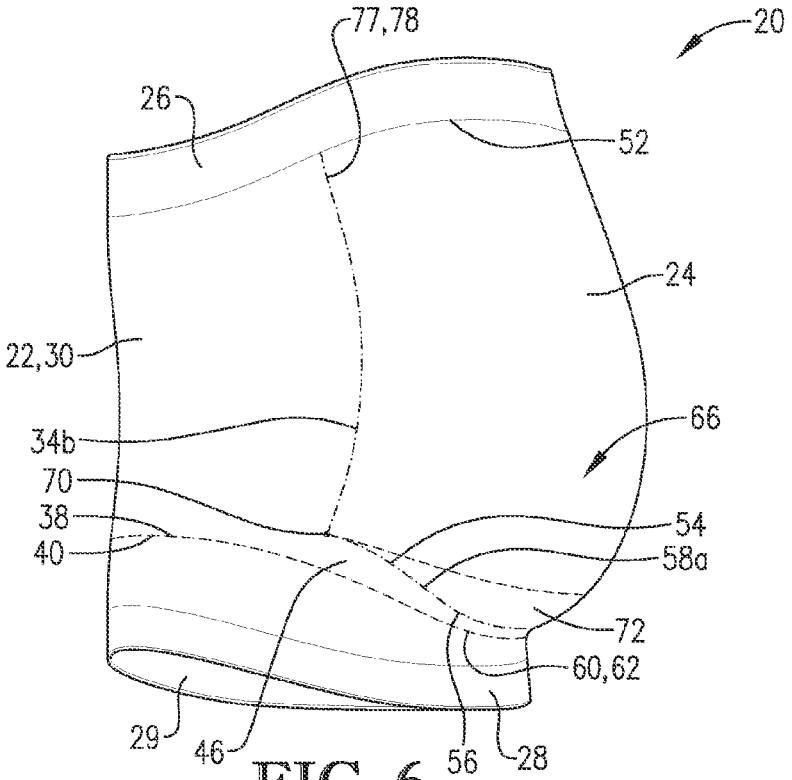
FIG. 6 is a left side elevation of the seamless underwear similar to FIG. 3, but showing the underwear in the stretched condition, with the back panel being stretched outwardly to enlarge the interior pocket so as to receive the buttocks of a wearer.
Figure 7:
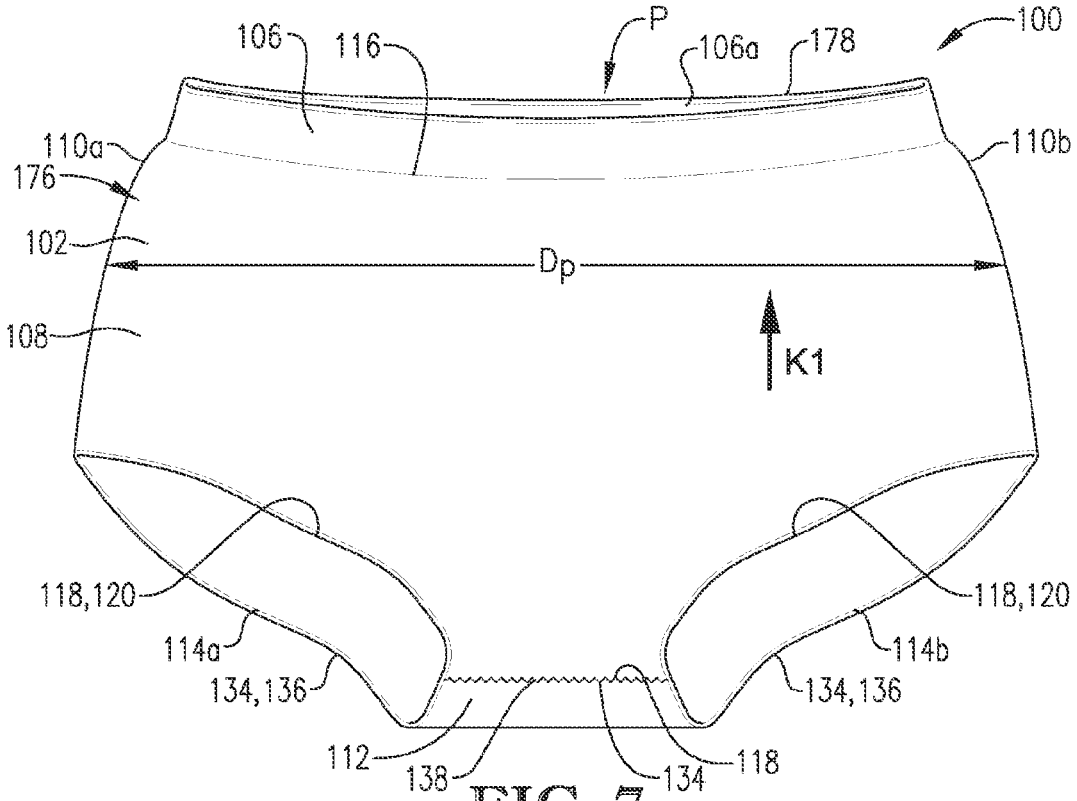
FIG. 7 is a front elevation of a seamless underwear constructed in accordance with a second embodiment of the present invention, with the underwear being depicted in an unstretched condition and including front and back panels and a waist band, and with an all needle rib interlocking knit construction in the crotch area being shown schematically.

The underwear 20 also includes leg bands 28 knitted to form the bottom margin of the receptacle and to define corresponding leg openings 29 (see FIGS. 4 and 6). The leg bands 28 are also preferably knitted by one-system ¼-gauge knitting on the flat bed knitting machine. For some aspects of the present invention, the underwear could have alternatively constructed leg bands, such as a half-gauge knit or a mock knit rib. Furthermore, various yarn thread materials, tensions, and deniers could be used to produce the leg bands 28.

Turning to FIGS. 1-6, the front and back panels 22,24 are integrally knitted to form a substantial portion of the receptacle, with the receptacle being dimensioned and configured to be donned by the wearer. As will be discussed, the front panel 22 is seamlessly joined to the back panel 24 along a junction so that the panels cooperatively form a passage P through the receptacle (see FIG. 4). Also, the front and back panels 22,24 preferably have distinct configurations so that the receptacle conforms to the wearer. The front panel 22 is unitary and includes a continuous trunk section 30 and leg sections 32*a,b*. The front panel 22 also presents opposite side margins 34*a,b*. The knitting process integrally joins a top margin 36 of the trunk section 30 to the waist band 26. A bottom margin 38 of the trunk section 30 is similarly knitted with, and thereby integrally joined to, a top margin 40 of the leg sections 32*a,b*, with the leg sections 32*a,b* being spaced apart from each other (see FIGS. 1 and 4). A bottom margin 42 of each of the leg sections is knitted with and integrally joined to the corresponding one of the leg bands 28. The illustrated trunk and leg sections 30,32*a,b* are preferably formed by courses of single jersey knitting.

While the construction of the illustrated front panel 22 is preferred, it is also within the principles of the present invention where the front panel 22 has an alternative configuration. For instance, the front panel 22 could be devoid of leg sections 32*a,b*, as will be shown in the subsequent embodiment. It is also consistent with the scope of the present invention where the front panel 22 includes other features, such as an openable fly closure.

Figure 5:
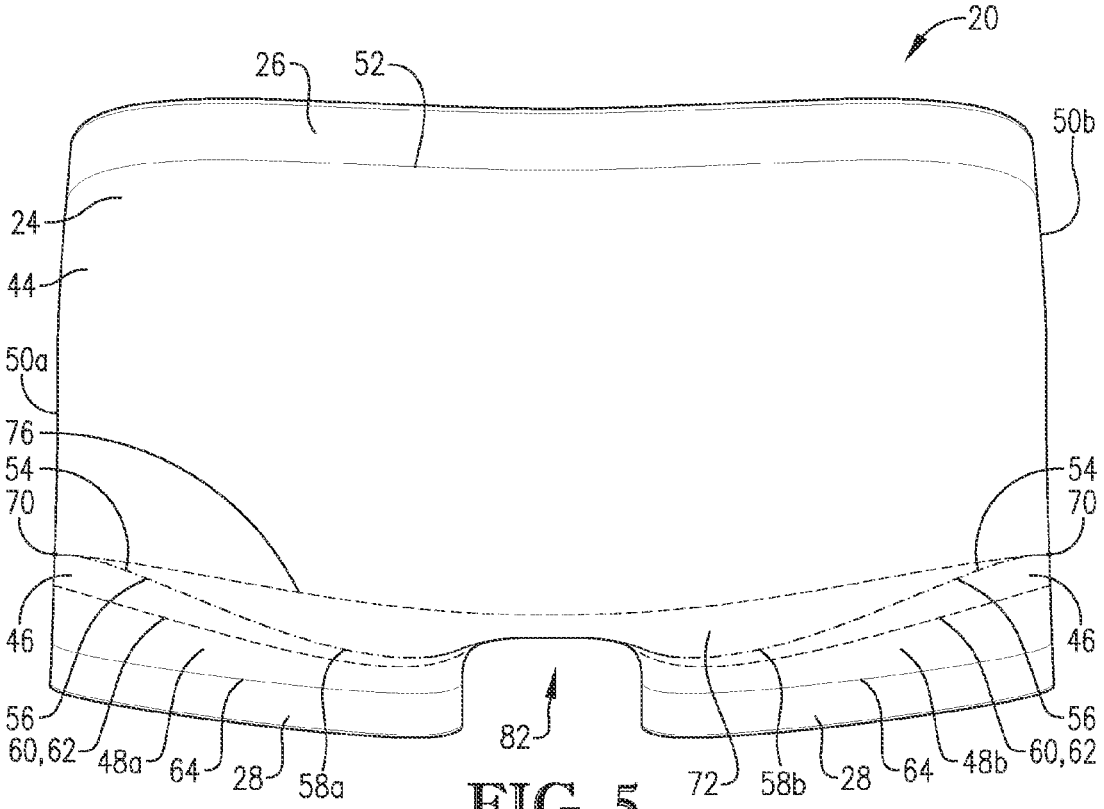
FIG. 5 is a rear elevation of the seamless underwear similar to FIG. 2, but showing the underwear in the stretched condition.

The back panel 24 is unitary and includes upper and lower trunk sections 44,46 and leg sections 48*a,b* (see FIGS. 2 and 5). The back panel 24 also presents opposite side margins 50*a,b*. A top margin 52 of the upper trunk section 44 is knitted with and integrally joined to the waist band 26. A bottom margin 54 of the upper trunk section 44 is knitted with and integrally joined to a top margin 56 of the lower trunk section 46. As will be discussed, the trunk sections 44,46 are preferably knitted with and integrally joined to one another along lines of tuck/knit fashionings 58*a,b*.

A bottom margin 60 of the lower trunk section 46 is knitted with and integrally joined to a top margin 62 of the leg sections 48*a,b*, with the leg sections 48*a,b* being spaced apart from each other. A bottom margin 64 of each of the leg sections 48*a,b* is knitted with and integrally joined to the corresponding one of the leg bands 28. The illustrated trunk and leg sections 44,46,48*a,b* are preferably formed by courses of single jersey knitting.

As mentioned, the trunk sections 44,46 are preferably joined along two lines of tuck/knit fashionings 58*a,b*, which serve to shape the back panel 24 so as to form an interior pocket 66 (see FIG. 6). Preferably, the fashionings 58*a,b* extend from inboard ends 68 that are spaced apart from one another to outboard ends 70 that generally coincide with the side margins 50*a,b* of back panel 24 (see FIG. 2). As will be explained, the fashionings are preferably spaced apart so that knitted courses are defined therebetween; however, the fashionings could alternatively be immediately adjacent one another if desired.

Knitting of the upper trunk section 44 is begun by first knitting a fashioning portion 72 of the upper trunk section 44. The fashioning portion 72 is started with a first course along line 74 (see FIG. 2). As additional courses are knitted in the upward knitting direction K2, the fashioning portion 72 presents a narrowing lateral width dimension Dn that increases progressively in the knitting direction K2. This progressively increasing lateral dimension Dn is produced by progressively adding needles to knit the courses, which produces the line of fashionings 58 that knit the trunk sections 44,46 to one another. The courses within the fashioning portion 72 increase in lateral dimension along the knitting direction K2 until a full width course 76 spans the back panel from one side margin 50 to the other side margin 50.

In the illustrated back panel 24, the progressively increasing lateral width of courses is preferably provided by adding a predetermined number of needles for knitting for a predetermined number of courses knitted, which is referred to herein as a fashioning ratio Rn. In particular, the fashioning ratio Rn is preferably four (4) needles added for every two (2) courses knitted. In other words, after every two courses are knitted in the fashioning portion, four needles are added at each end of the courses so that the next two courses are knitted with four additional wales at each end thereof. Thus, the fashionings 58 join upper courses from the upper trunk section 44 and lower courses from the lower trunk section 46 so that the upper and lower courses are joined at an oblique angle to one another.

The principles of the present invention are equally applicable where the fashioning of the back panel 24 is alternatively configured. For instance, the fashioning portion 72 could be knitted with a fashioning ratio Rn of four (4) needles added for every four (4) courses knitted so as to change the oblique angle between upper and lower courses. It is also within the ambit of the present invention where the fashionings 58 are alternatively positioned along the back panel 24. For instance, the back panel 24 could include a single line of fashionings that extends from one side margin to the other side margin of back panel 24.

Furthermore, it is also within the scope of the present invention to provide alternative fashionings along the back panel. For instance, the back panel 24 could have fashionings where needles are progressively removed as courses are knitted. Details of such fashionings are disclosed in U.S. Pat. No. 6,158,253, issued Dec. 12, 2000, entitled SEAMLESS, FORM FITTING FOOT SOCK, which is hereby incorporated in its entirety by reference herein.

The front and back panels 22,24 are preferably integrally knitted to form a substantial portion of the receptacle. In particular, the side margins 34 of the front panel 22 are knitted with respective side margins 50 of the back panel 24. Preferably, the panels 22,24 are integrally joined along oppositely spaced junctions 77 that extend from the waist band 26 to corresponding leg bands 28. More preferably, a vertical line of fashionings 78 extends from the waist band 26 to a location between the waist band 26 and leg band 28 so that the underwear 20 is tapered, as will be discussed.

Preferably, fashioning is performed by making a transfer narrowing at the end of a course so that one needle is reduced. Courses with transfer narrowings are preferably located periodically along the knitting directions K. In other words, adjacent courses with transfer narrowings (i.e., empty transfer courses) are separated by one or more courses without transfer narrowings (i.e., single jersey knit courses).

More preferably, in the illustrated embodiment, the receptacle includes a repeating pattern of courses that extend to fashionings 78. Specifically, the repeating pattern includes a first transfer course followed by a first series of single jersey knit courses. The pattern then includes a second transfer course followed by a second series of single jersey knit courses. This pattern is then repeated starting with the first transfer course. Thus, the pattern presents alternating first and second series of single jersey knit courses, with each pair of adjacent series being separated by transfer courses. In the preferred embodiment, the first series of single jersey knit courses includes one more course than the second series of single jersey knit courses. However, it will be appreciated that the receptacle could be configured to have various numbers of single jersey knit courses between transfer courses without departing from the scope of the present invention. For instance, the receptacle could include first and second series of single jersey knit courses with the same number of courses. Furthermore, as will be shown in the subsequent embodiment, the principles of the present invention are applicable where the receptacle does not include fashionings to knit the panels 22,24 to one another.

The illustrated receptacle is preferably knitted so as to present a tapered section 80 (see FIGS. 1 and 2). In an unstretched condition, the underwear 20 presents a cross-sectional passage dimension Dp along the tapered section 80 that tapers in a direction toward the uppermost waist band 26 so that the receptacle is operable to be retained on the wearer when the underwear is donned (see FIG. 1). Preferably, the illustrated tapered section 80 is cooperatively formed by the fashionings 78 and by the alternative knitting pattern of the waist band 26. However, for some aspects of the present invention, such tapering of the underwear 20 could be provided by one of, or neither of, these features.

The underwear 20 is preferably knitted on a flat bed knitting machine, such as those commercially available from Shima Seiki or Stoll. The knitting process is initiated by knitting a conventional setup section (not shown). With the setup section completed, the leg bands 28 are knitted using a pair of yarn carriers of a multi-system machine (i.e., where front and back portions of each leg band are supplied with yarn from a respective yarn carrier). As discussed, the leg bands 28 are formed by multiple courses of ¼-gauge knit. From the leg bands 28, knitting continues with the knitting of each pair of leg sections 32,48 with courses of single jersey knit.

The panels 22,24 cooperatively present a crotch area 82 between the leg sections. The lower margin of the crotch area 82 is formed by ½-gauge, interlocking stitches that integrally join the front and back panels 22,24 to one another in the crotch area 82. With the interlocking stitches formed, knitting of the front and back panels 22,24, including the lower trunk section 46, continues by knitting with a single yarn carrier of the multi-system machine to form courses of single jersey knit.

When the lower trunk section 46 is completed, the knitting machine is operated so as to hold the needles associated with the front panel 22 and needles associated with the back panel 24, except for those located along line 74. Thus, the machine can begin knitting the fashioning portion 72 of upper trunk section 44. As courses are knitted in the upward knitting direction K2, the fashioning portion 72 presents a tuck/knit lateral dimension Dn that increases progressively in the knitting direction K2. Again, this progressively increasing lateral dimension is produced by progressively adding needles as courses are knitted. The courses within the fashioning portion 72 increase progressively in lateral dimension along the knitting direction K2 until the full width course 76 spans the back panel 24 from one side margin 50 to the other side margin 50.

With the fashioning portion 72 knitted, the needles associated with the front panel 22 would be released for knitting. Thus, knitting would resume on both the front and back panels 22,24 by knitting single jersey courses up to the waist band 26 using a single yarn carrier. The waist band 26 is then knitted with multiple courses of one-system ¼-gauge knit. Finally, the waist band 26 is completed with a conventional interlocking stitch 84.

Turning to FIGS. 4-6, the illustrated construction of underwear 20 has been found to provide a snug and comfortable fit, particularly for boys. In particular, the waist band 26 and lines of fashionings 78 stretch to permit donning of the underwear 20 while serving to restrict the underwear 20 from falling in a downward direction. Also, the lateral fashionings 58 permit the back panel 24 to stretch so that the interior pocket 66 is enlarged from its size in the unstretched condition. In this manner, the back panel 24 stretches to accommodate the buttocks of the wearer.

Turning to FIGS. 7-12, an alternative preferred embodiment of the present invention is depicted. For the sake of brevity, the remaining description will focus primarily on the differences of this alternative embodiment from the preferred embodiment described above.

An alternative seamless underwear 100 is constructed in accordance with a second embodiment of the present invention and broadly includes alternative front and back panels 102,104 and a waist band 106. The waist band 106 is knitted to form the top margin of the receptacle and define a waist opening 106*a* (see FIGS. 7 and 9). The waist band 106 is knitted by one-system ¼-gauge knitting on the flat bed knitting machine. Again, for some aspects of the present invention, the underwear 100 could have an alternatively constructed waist band, such as a half-gauge knit or a mock knit rib. Also, various yarn thread materials, tensions, and deniers could be used to produce the waist band 106. While the illustrated underwear 100 is devoid of leg bands similar to leg bands 28, it is within the scope of the present invention where such leg bands are incorporated to form leg openings of the underwear 100.

The alternative front and back panels 102,104 are integrally knitted to form a receptacle that is dimensioned and configured to be donned by a wearer. As will be discussed, the front panel 102 is seamlessly joined to the back panel 104 so that the panels cooperatively form a passage P through the receptacle (see FIG. 9). Also, the front and back panels 102, 104 have distinct configurations so that the receptacle conforms to the wearer. The front panel 102 is unitary and includes a continuous trunk section 108. The front panel 102 also presents opposite side margins 110*a,b* (see FIGS. 7 and 9). As will be discussed, the front and back panels 102,104 cooperatively define a crotch area 112 that separates leg openings 114*a,b* presented by the receptacle.

A top margin 116 of the trunk section 108 is preferably knitted with and thereby joined to the waist band 106. A portion of a bottom margin 118 of the trunk section 108 is also preferably joined to a selvage 120 to partly define the leg openings 114 (see FIGS. 7 and 9). However, it is within the ambit of the present invention where the leg openings 114 are defined by an alternative edge knitting, such as a series of interlocking stitches. Another portion of the bottom margin 118 is also joined to the corresponding portion of the back panel 104 along the crotch area 112 with interlocking stitches. The illustrated trunk section 108 is preferably formed by courses of single jersey knit construction.

While the illustrated construction of the front panel 102 is preferred, it is also within the principles of the present invention where the front panel 102 has an alternative configuration. For instance, the front panel 102 could include other features, such as an openable fly closure.

Figure 8:
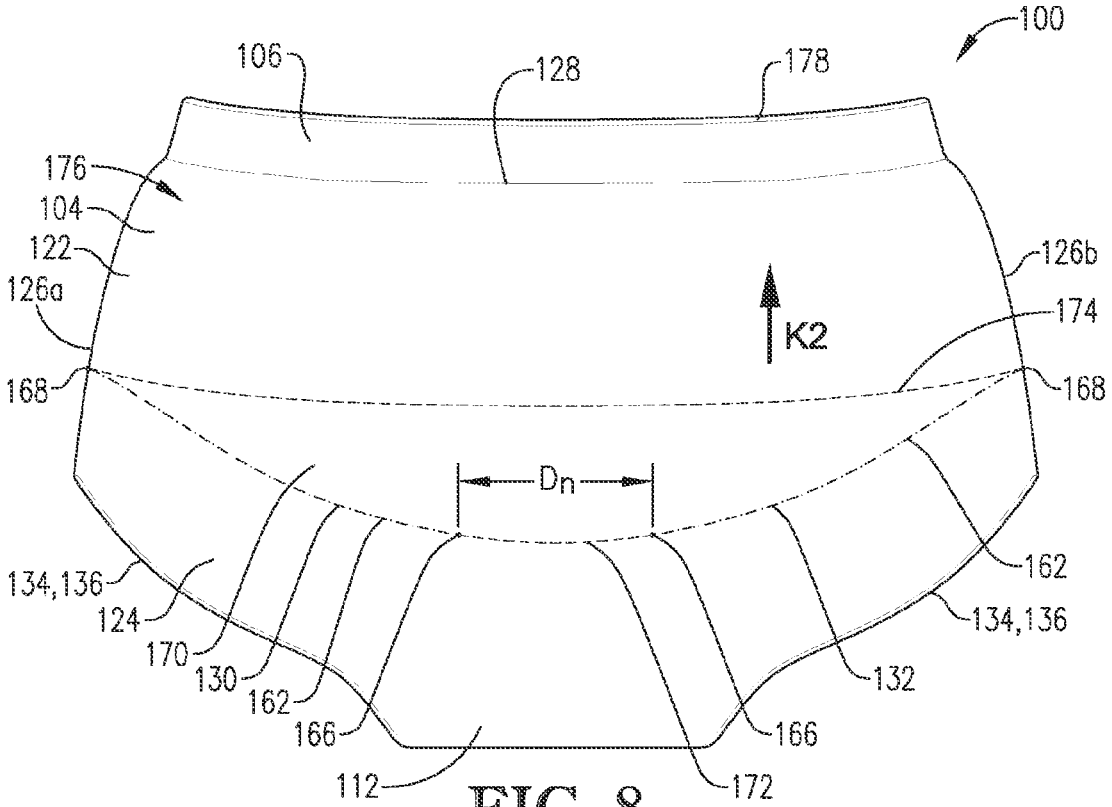
FIG. 8 is a rear elevation of the seamless underwear shown in FIG. 7, showing upper and lower trunk sections of the back panel, with the sections being integrally joined along lines of fashioned knit construction (depicted schematically) so that the back panel forms an interior pocket.
Figure 9:
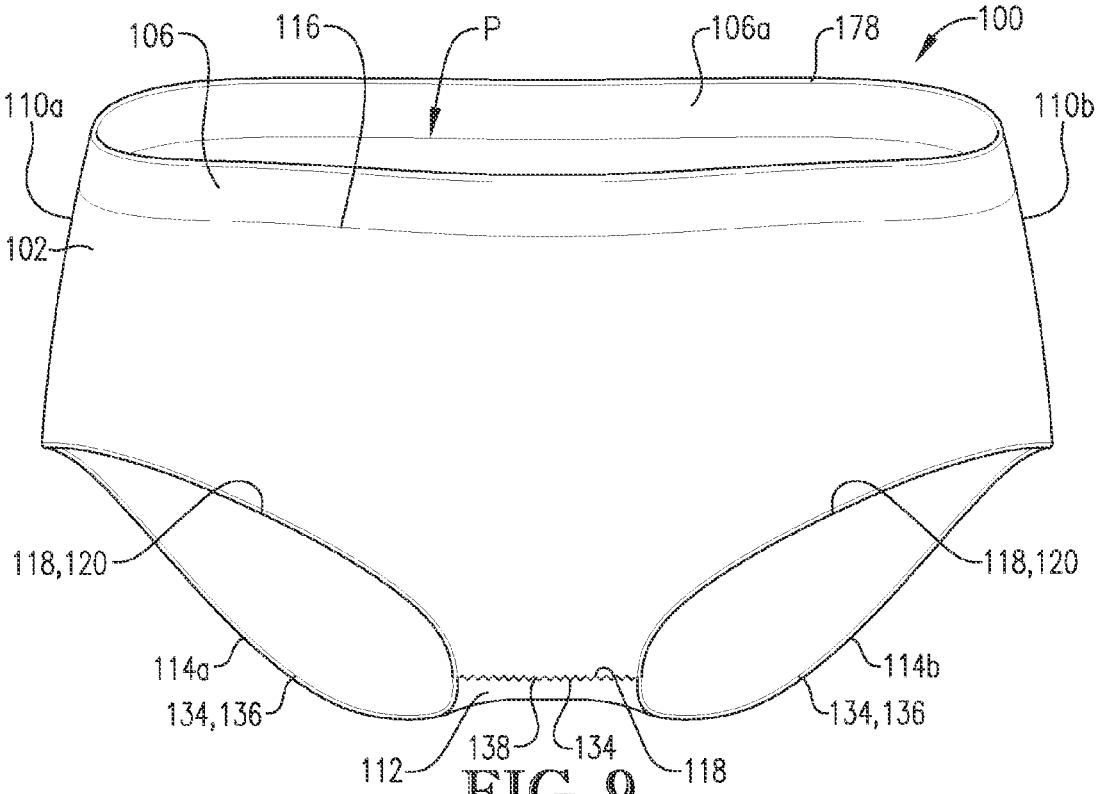
FIG. 9 is a front elevation of the seamless underwear similar to FIG. 7, but showing the underwear in a stretched condition generally associated with donning of the underwear.

Turning to FIGS. 8 and 10, the back panel 24 is unitary and includes upper and lower trunk sections 122,124. The back panel 24 also presents opposite side margins 126*a,b*. A top margin 128 of the upper trunk section 122 is preferably knitted with and thereby joined to the waist band 106. The upper trunk section 122 also has a bottom margin 130 that is preferably knitted with a top margin 132 of the lower trunk section 124. As will be discussed, the trunk sections 122,124 are preferably integrally joined along lines of fashionings.

The lower trunk section 124 is preferably knitted along part of a bottom margin 134 thereof with a selvage 136 to form leg openings 114. Again, it is within the ambit of the present invention where the leg openings 114 are defined by an alternative edge knitting, such as a series of interlocking stitches. As mentioned, the remaining portion of the bottom margin 134 is joined to the corresponding part of front panel 102 along the crotch area 112 by a line of all needle rib interlocking knit construction 138. The illustrated trunk sections 122, 124 are preferably formed by courses of single jersey knitting.

Turning to FIG. 12, the front and back panels 102,104 cooperatively define the crotch area 112. Preferably, the crotch area 112 includes a central portion 140 and front and back fashioning portions 142,144. The illustrated central portion 140 is cooperatively formed by the front and back panels 102,104 and presents a crotch lateral width dimension Dc that preferably has a constant number of wales along a length Lc of the central portion. Thus, the central portion 140 extends along the front panel 102 from the line of all needle rib interlocking knit construction 138 so as to present a front length dimension Lf. The central portion 140 also extends along the back panel 104 from the line of all needle rib interlocking knit construction 138 to present a back length dimension Lb. The front length dimension Lf is preferably greater than the back length dimension Lb.

For the illustrated receptacle, the front length dimension Lf preferably ranges from about twenty (20) courses to about thirty (30) courses and, more preferably, is about twenty-two (22) courses. However, for one preferred large size of underwear, the first length dimension Lf is about twenty-nine (29) courses. Also for the illustrated receptacle, the back length dimension Lb preferably ranges from about ten (10) courses to about twenty-five (25) courses and, more preferably, is about fourteen (14) courses. However, for one preferred large size of underwear, the back length dimension Lb is about twenty-one (21) courses.

The front fashioning portion 142 includes a series of lower front fashioning courses 146 and a series of upper front fashioning courses 148. The fashioning courses 146,148 define corresponding lower and upper edges 150,152 of the fashioning portion, with the edges presenting respective angles $\alpha$1,$\alpha$2 relative to the knitting direction K1. Preferably, the fashioning portion 142 is formed so that angle $\alpha$2 is greater than angle $\alpha$1.

The lateral width dimension Dc of the lower front fashioning courses 146 increases progressively along the knitting direction K1. In particular, the progressive widening for lower front fashioning courses 146 preferably has a widening ratio of adding one (1) needle for every one (1) course.

The lateral width dimension Dc of the upper front fashioning courses 148 also increases progressively along the knitting direction K1. This widening has a repeating pattern where one (1) needle is added for a first course and three (3) needles are added for a second course, with subsequent courses in the upper front fashioning portion following this pattern. For some aspects of the present invention, the indicated fashionings for the front fashioning portion 142 identified above could be modified without departing from the scope of the present invention.

The back fashioning portion 144 includes a configuration of courses and widenings that is similar to the front fashioning portion 142. As with the front fashioning portion 142, the back fashioning portion 144 includes lower front fashioning courses 154 and upper front fashioning courses 156. The courses 154,156 define corresponding lower and upper edges 158,160 of the fashioning portion 144, with the edges presenting respective angles $\alpha$3,$\alpha$4 relative to the knitting direction K2. Preferably, the fashioning portion 144 is formed so that angle $\alpha$4 is greater than angle $\alpha$3.

Turning again to FIGS. 7-12, similar to the previous embodiment, the trunk sections of back panel 104 are preferably joined along two lines of tuck/knit fashionings 162, which serve to shape the back panel 104 so as to form an interior pocket 164 (see FIG. 11). Preferably, the fashionings 162 extend from inboard ends 166 that are spaced apart from one another to outboard ends 168 that generally coincide with the side margins 126 of back panel 104.

Knitting of the upper trunk section 122 is begun by first knitting a fashioning portion 170. The fashioning portion 170 is started with a first course along line 172 (see FIG. 8). As additional courses are knitted in the upward knitting direction K2, the fashioning portion 170 presents a lateral width dimension Dn that increases progressively in the knitting direction K2. This progressively increasing lateral dimension is produced by progressively adding needles to knit the courses, which produces the line of fashionings 162 that join the trunk sections 122,124 to one another. The courses within the fashioning portion 170 increase in lateral dimension along the knitting direction K2 until a full width course 174 spans the back panel 104 from one side margin 126 to the other side margin 126.

In the illustrated back panel 104, the lateral dimension of the progressively increasing course size is preferably performed by increasing the number of needles to the number of courses at a fashioning ratio of eight (8) needles for every two (2) courses. In other words, after every two courses knitted in the fashioning portion, eight needles are added at each end of the courses so that the next two courses are knitted with eight additional wales at each end thereof. Thus, the tuck/knit fashionings 162 join upper courses from the upper trunk section 122 and lower courses from the lower trunk section 124 so that the upper and lower courses are joined at an oblique angle to one another.

The principles of the present invention are equally applicable where the fashioning of the back panel 104 is alternatively configured. For instance, one alternative fashioning ratio that has been found suitable for large underwear sizes is ten (10) needles for every two (2) courses. One suitable fashioning ratio for small underwear sizes is six (6) needles for every two (2) courses. It will be appreciated that such ratios result in correspondingly different oblique angles between the upper and lower courses. It is also within the ambit of the present invention where the tuck/knit fashionings 162 are alternatively positioned along the back panel 104. For instance, the back panel 104 could include a single line of fashionings that extends from one side margin to the other side margin of back panel 104.

The front and back panels 102,104 are preferably integrally knitted to form a substantial portion of the receptacle. Initially, the front and back panels 102,104 are joined to each other by the all needle rib interlocking knit construction 138 along crotch area 112. Also, the side margins 110 of the front panel 102 are knitted with the side margins 126 of the back panel 104 along opposite junctions that extend from the waist band 106 to the corresponding leg opening 114. Preferably, the panels 102,104 are not joined to one another with fashionings, although fashionings could be utilized without departing from the scope of the present invention. The illustrated construction of the receptacle provides a tapered section 176. In an unstretched receptacle condition, the tapered section 176 presents a cross-sectional passage dimension Dp that tapers in a direction toward the uppermost waist band 106 so that the receptacle is operable to be retained on the wearer when the underwear is donned.

The underwear 100 is preferably knitted on a flat bed knitting machine. The knitting process is initiated by knitting a conventional setup section (not shown). With the setup section completed, the lower margin of crotch area 112 is formed by single jersey knit that integrally joins the front and back panels 102,104 to one another in the crotch area 112. With the all needle rib interlocking knit construction formed, knitting of the front and back panels 102, 104, including the lower trunk section, continues with courses of two-system single jersey knit construction.

When the lower trunk section 124 is completed, the machine is operated so as to hold the needles associated with the front panel 102 and needles associated with the back panel 104 except for those located along line 172. Thus, the machine can begin knitting the fashioning portion 170 of upper trunk section 122. As courses are knitted in the upward knitting direction K2, the fashioning portion presents a lateral width dimension Dn that increases progressively in the knitting direction K2. Again, this progressively increasing lateral dimension is produced by progressively adding needles to knit the courses. The courses within the fashioning portion 170 increase progressively in lateral dimension along the knitting direction K2 until the full width course 174 spans the back panel from one side margin 126 to the other side margin 126.

With the fashioning portion 170 knitted, the needles associated with the front panel 102 would be released for knitting. Thus, knitting would resume on both the front and back panels 102,104 by knitting single jersey knit courses up to the waist band 106, preferably with a single yarn carrier. The waist band 106 is then knitted with multiple courses of one-system ¼-gauge knit, preferably with a single yarn carrier. Finally, the waist band 106 is completed with a conventional interlocking stitch 178.

The illustrated construction of underwear 100 has been found to provide a snug and comfortable fit, particularly for girls. In particular, the waist band 106 and panels 102,104 stretch to permit donning of the underwear 100 while serving to restrict the underwear from falling in a downward direction. Also, the lateral fashionings permit the back panel 104 to stretch so that the interior pocket is enlarged from its size in the unstretched condition. In this manner, the back panel 104 stretches to accommodate the buttocks of the wearer.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A stretchable seamless underwear operable to be donned by a wearer, said stretchable seamless underwear comprising:

a seamless knitted fabric receptacle including integrally knitted front and back panels that each present opposite side margins, with each side margin of the front panel being seamlessly joined to a corresponding side margin of the back panel so that the panels cooperatively form a passage through the receptacle, said receptacle including an uppermost knitted waist band that is integrally knitted with the front and back panels and forms an upper waist opening dimensioned and configured to receive the torso of the wearer when the underwear is donned, said front and back panels cooperatively defining a tapered section of the receptacle, said receptacle having an unstretched condition where the tapered section presents a cross-sectional passage dimension tapering in a direction toward the uppermost waist band so that the receptacle is operable to be retained on the wearer when the underwear is donned, said waist band being formed of a different knitting pattern than the tapered section to thereby urge the tapered section into the unstretched condition.

2. The stretchable seamless underwear as claimed in claim 1, said waist band comprising a ¼-gauge knit.

3. The stretchable seamless underwear as claimed in claim 2, said panels being at least partly knitted with courses of single jersey knitting.

4. The stretchable seamless underwear as claimed in claim 1, said tapered section including fashioning knit construction defined along a junction of the panels to at least in part define the tapered section.

5. The stretchable seamless underwear as claimed in claim 4, said receptacle defining a pair of lower leg openings between the front and back panels, said back panel including upper and lower sections, at least part of said upper and lower sections being joined along a laterally extending line of fashionings located vertically between the waist opening and the leg openings.

6. The stretchable seamless underwear as claimed in claim 1, said tapered section including fashioning knit construction defined along a junction of the panels to at least in part define the tapered section.

7. The stretchable seamless underwear as claimed in claim 1, said receptacle defining a pair of lower leg openings between the front and back panels, said back panel including upper and lower sections, at least part of said upper and lower sections being joined along a laterally extending line of fashionings located vertically between the waist opening and the leg openings.

8. The stretchable seamless underwear as claimed in claim 1, said receptacle defining a pair of lower leg openings between the front and back panels, with the leg openings operable to receive a corresponding leg of the wearer when the underwear is donned.

9. The stretchable seamless underwear as claimed in claim 8, at least one of the front and back panels defining a crotch area that separates the pair of lower leg openings.

10. The stretchable seamless underwear as claimed in claim 9, said crotch area including a central portion that presents a constant lateral width dimension along a length of the central portion.

11. The stretchable seamless underwear as claimed in claim 10, said crotch area including front and back fashioning portions, where the lateral width dimension of each fashioning portion increases in a knitting direction away from the central portion.

12. A stretchable seamless underwear operable to be donned by a wearer, said stretchable seamless underwear comprising:

a seamless knitted fabric receptacle including integrally knitted front and back panels that each present opposite side margins, with each side margin of the front panel being seamlessly joined to a corresponding side margin of the back panel so that the panels cooperatively form a passage through the receptacle, said receptacle including an uppermost knitted waist band that is integrally knitted with the front and back panels and forms an upper waist opening dimensioned and configured to receive the torso of the wearer when the underwear is donned, said front and back panels cooperatively defining a tapered section of the receptacle, said receptacle having an unstretched condition where the tapered section presents a cross-sectional passage dimension tapering in a direction toward the uppermost waist band so that the receptacle is operable to be retained on the wearer when the underwear is donned, said receptacle defining a pair of lower leg openings between the front and back panels, with the leg openings operable to receive a corresponding leg of the wearer when the underwear is donned, at least one of the front and back panels defining a crotch area that separates the pair of lower leg openings, said crotch area including a central portion that presents a constant lateral width dimension along a length of the central portion, said front and back panels being integrally knitted along a lateral line of all needle rib interlocking knit construction positioned within the crotch area, said central portion extending a first length dimension along the front panel from the line of all needle rib interlocking knit construction, said central portion extending a second length dimension along the back panel from the line of all needle rib interlocking knit construction, with the first length dimension being greater than the second length dimension.

13. The stretchable seamless underwear as claimed in claim 8, said front and back panels including a pair of leg sections that are spaced apart from one another.

14. The stretchable seamless underwear as claimed in claim 13, said receptacle including a pair of leg bands, each of the leg bands being integrally knitted with respective leg sections of the front and back panels and forming a corresponding one of the lower leg openings.

15. A stretchable seamless underwear operable to be donned by a wearer, said stretchable seamless underwear comprising:

a seamless knitted fabric receptacle including integrally front and back panels that each present opposite side margins, with each side margin of the front panel being seamlessly joined to a corresponding side margin of the back panel so that the panels cooperatively form a passage through the receptacle, said receptacle including an uppermost knitted waist band that is integrally knitted with the front and back panels and forms an upper waist opening dimensioned and configured to receive the torso of the wearer when the underwear is donned, said front and back panels cooperatively defining a tapered section of the receptacle, said receptacle having an unstretched condition where the tapered section presents a cross-sectional passage dimension tapering in a direction toward the uppermost waist band so that the receptacle is operable to be retained on the wearer when the underwear is donned, said receptacle defining a pair of lower leg openings between the front and back panels, with the leg openings operable to receive a corresponding leg of the wearer when the underwear is donned, said cross-sectional passage dimension tapering only from a location between the waist opening and leg openings toward the waist band.

16. The stretchable seamless underwear as claimed in claim 1, said receptacle being knitted with a high-stretch yarn.

17. The stretchable seamless underwear as claimed in claim 16, said high-stretch yarn including corespun yarn.

18. A stretchable seamless underwear operable to be donned by a wearer, said stretchable seamless underwear comprising:

a seamless knitted fabric receptacle including integrally knitted front and back panels that each present opposite side margins, with each side margin of the front panel being seamlessly joined to a corresponding side margin of the back panel so that the panels cooperatively form a passage through the receptacle, said receptacle including an uppermost knitted waist band that is integrally knitted with the front and back panels and forms an upper waist opening dimensioned and configured to receive the torso of the wearer when the underwear is donned, said front and back panels cooperatively defining a tapered section of the receptacle, said receptacle having an unstretched condition where the tapered section presents a cross-sectional passage dimension tapering in a direction toward the uppermost waist band so that the receptacle is operable to be retained on the wearer when the underwear is donned, said receptacle defining a pair of lower leg openings between the front and back panels, with the leg openings operable to receive a corresponding leg of the wearer when the underwear is donned, said back panel including upper and lower sections, at least part of said upper and lower sections being joined along a laterally extending line of fashionings located vertically between the waist opening and the leg openings so that the back panel presents a fashioned interior pocket that forms part of the passage and is operable to receive the buttocks of the wearer when the underwear is donned.

19. A stretchable seamless underwear operable to be donned by a wearer, said stretchable knitted underwear comprising:

a seamless knitted fabric receptacle including integrally knitted front and back panels that each present opposite side margins, with each side margin of the front panel being seamlessly joined to a corresponding side margin of the back panel so that the panels cooperatively form a passage through the receptacle, said receptacle presenting an uppermost waist opening dimensioned and configured to receive the torso of the wearer when the underwear is donned, said receptacle defining a pair of lower leg openings between the front and back panels, with the leg openings operable to receive a corresponding leg of the wearer when the underwear is donned, said back panel including upper and lower sections, at least part of said upper and lower sections being joined along a laterally extending line of fashionings located vertically between the waist opening and the leg openings so that the back panel presents a fashioned interior pocket that forms part of the passage and is operable to receive the buttocks of the wearer when the underwear is donned.

20. The stretchable seamless underwear as claimed in claim 19, said line of fashionings comprising a plurality of spaced apart fashionings, such that adjacent fashionings are separated by at least one course of knitting.

21. The stretchable seamless underwear as claimed in claim 19, said upper and lower sections being joined along another laterally extending line of fashionings, with each line of fashionings extending along a respective one of the leg openings.

22. The stretchable seamless underwear as claimed in claim 21, said lines of fashionings each presenting a laterally inboard end, with the laterally inboard ends being spaced apart from one another.

23. The stretchable seamless underwear as claimed in claim 21, said lines of fashionings each presenting a laterally outboard end, with the laterally outboard ends being located adjacent to a respective one of the side margins of the back panel.

24. The stretchable seamless underwear as claimed in claim 19, said seamlessly joined side margins being at least partly joined by a vertical line of fashionings.

25. The stretchable seamless underwear as claimed in claim 19, said upper and lower sections being formed by respective upper and lower knitted courses, said line of fashionings joining the upper and lower courses along an oblique angle to one another.

26. The stretchable seamless underwear as claimed in claim 25, said lower knitted courses including multiple one-system single jersey knit courses.

27. The stretchable seamless underwear as claimed in claim 19, said receptacle defining a pair of lower leg openings between the front and back panels, with the leg openings operable to receive a corresponding leg of the wearer when the underwear is donned.

28. The stretchable seamless underwear as claimed in claim 27, at least one of the front and back panels defining a crotch area that separates the pair of lower leg openings.

29. The stretchable seamless underwear as claimed in claim 27, said crotch area including a central portion that presents a constant lateral width dimension along a length of the central portion.

30. The stretchable seamless underwear as claimed in claim 29, said crotch area including front and back fashioning portions, where the lateral width dimension of each fashioning portion increasing in a knitting direction away from the central portion.

31. The stretchable seamless underwear as claimed in claim 29, said front and back panels being integrally knitted along a lateral line of all needle rib interlocking knit construction positioned within the crotch area, said central portion extending a first length dimension along the front panel from the line of all needle rib interlocking knit construction, said central portion extending a second length dimension along the back panel from the line of all needle rib interlocking knit construction, with the first length dimension being greater than the second length dimension.

32. The stretchable seamless underwear as claimed in claim 27, said front and back panels including a pair of leg sections that are spaced apart from one another.

33. The stretchable seamless underwear as claimed in claim 32, said receptacle including a pair of leg bands, each of the leg bands being integrally knitted with respective leg sections of the front and back panels and forming a corresponding one of the lower leg openings.

34. The stretchable seamless underwear as claimed in claim 19, said receptacle being knitted with a high-stretch yarn.

35. The stretchable seamless underwear as claimed in claim 34, said high-stretch yarn including corespun yarn.

* * * * *